US005548375A

United States Patent [19]

Mitsuya et al.

[11] Patent Number: 5,548,375

[45] Date of Patent: Aug. 20, 1996

[54] INTEGRATED PRINTING SYSTEM FOR AUTOMATED AND MAINTENANCE FREE OPERATION

[75] Inventors: Teruaki Mitsuya, Naka-machi; Hisao Okada, Hitachi; Nobuyoshi Hoshi, Hitachinaka, all of Japan

[73] Assignee: Hitachi, Ltd., Tokyo, Japan

[21] Appl. No.: 398,703

[22] Filed: Mar. 6, 1995

[30] Foreign Application Priority Data

Mar. 18, 1994 [JP] Japan ..... 6-048249

[51] Int. Cl.[6] ..... G03G 15/00; G03G 21/00

[52] U.S. Cl. ..... 355/200; 355/215

[58] Field of Search ..... 355/215, 326, 355/200; 347/43, 104, 115, 172, 139, 232; 364/478, 471

[56] References Cited

U.S. PATENT DOCUMENTS

| | | | |
|---|---|---|---|
| 4,341,167 | 7/1982 | St. John | 110/235 |
| 4,803,634 | 2/1989 | Ohno et al. | 364/478 |
| 4,876,606 | 10/1989 | Banno et al. | 358/434 |
| 5,150,167 | 9/1992 | Gonda et al. | 355/313 |
| 5,277,111 | 1/1994 | Uribe et al. | 101/425 |

FOREIGN PATENT DOCUMENTS

| | | |
|---|---|---|
| 3630876 | 3/1987 | European Pat. Off. . |
| 0267493 | 5/1988 | European Pat. Off. . |
| 0336149 | 10/1989 | European Pat. Off. . |
| 58-57962A | 4/1983 | Japan . |
| 2-188244A | 7/1990 | Japan . |

*Primary Examiner*—Joan H. Pendegrass
*Assistant Examiner*—Quana Grainger
*Attorney, Agent, or Firm*—Kenyon & Kenyon

[57] ABSTRACT

A printing system capable of automatically controlling a plurality of printing devices with a minimized number of operators, includes a common handling mechanism for transporting and supplying coloring agents to the plurality of printing devices, a mechanism for handling printed media therebetween, each printing device being provided with printing media loader, and a common expendables handler for transporting expendables to the plurality of printing devices having automatic expendable loaders. The printing system further includes cutters for cutting printed media and collecting them from the printing devices, and a common handler for transporting the collected printed media to the post-process device, thereby, maintaining the operating environment of the printing devices clean and safe at a reduced cost and with the least possible workload.

8 Claims, 6 Drawing Sheets

INTEGRATED PRINTING SYSTEM FOR AUTOMATED AND MAINTENANCE FREE OPERATION

BACKGROUND OF THE INVENTION

The present invention relates to a printing system, and more particularly, it relates to a suitable configuration of a printing system for automatically operating and controlling plural sets of printing devices such as printers using an electrophotographic process or an ink jet process, and/or off-set printing machines for printing images using coloring agents such as toners or inks in liquid-state on printing media.

As prior art, there are known such printing devices as electrophotographic printers, ink jet printers and off-set printing machines.

For any printing devices such as electrophotographic printers, ink jet printers, off-set printing machines and relief-printing machines that print coloring agents such as toners or liquid inks onto printing media, an engineer or operator needs to carry out various operations and trouble-shooting including reloading of printing media, collecting of printed documents, replenishing of coloring agents, collection of waste coloring agents discharged during printing, cleaning of non-printed coloring agents and paper dregs which have been attached as stains and remain inside the printing devices, and coping with jamming of printing media under handling. A single operator can handle at most 5 printing devices a day in view of a standard work load involved. Depending on a work load, it sometimes occurs that a crew of plural operators is needed to fix one printing apparatus.

In addition to the above chores, a maintenance engineer or operator is needed to take care of replacing expendable items or exchanging parts in each printing devices. The expendable items, in case of electrophotographic printers, for example, include a photoconductor drum, heat fusing roller, toner cleaner brush and so on.

In particular, with respect to means for supplying coloring agents which are consumed in greater quantities, there is known such a prior art disclosed in Japanese Patent Application Laid-Open No. 58-57962, in which ink is distributed and supplied to each of plural ink jet printer devices from a single ink supply reservoir.

Further, after collecting of printed documents, there is needed a post-process such as cutting of printed documents, sorting, book-binding and the like. In particular, in case the printing media is provided in a long roll paper or a fan fold paper, cutting process is required before the post-process. A number of workers are required in the post-process to carry out cutting of the printed media, sorting, book-binding and the like.

Further, with respect to operational environments around the printing devices, due to volatile odorous substances contained in the coloring agents or due to ozone generated during charging process in the electrophotographic printer, there sometimes occurs such a problem that the work environment deteriorates substantially or life-cycles of components and parts in the printing devices are shortened by these by-product substances. Although some countermeasures have been taken against such problems, since each printing device must be equipped with environmental protection gadgets such as an ozone filter, additional expenditures such as for exchanging filters and related operations are incurred.

As another related art, there is known such a system as disclosed in Japanese Patent Application Laid-Open No. 2-188244.

In the above-mentioned prior art, however, there have been made no specific considerations about quantities of workload required for operation of the printing devices, i.e., for replacing expendable items and exchange components and parts in the printing device, and for the post-process such as cutting the printed media, sorting, book-binding and the like. Thereby, there was a problem that in order to operate smoothly and maintain the printing device in a good condition, a number of operators and service engineers are called for, and many other workers are required as well in the postprocessing thereof in order to arrange the printed papers in a preferred, suitable condition ready for use by users, such chores include cutting, sorting, bookbinding and the like.

Further, since there have been made no adequate attempts successfully to provide for a better operating environment and its efficient maintenance during operation of the printing devices, there was another problem associated with the prior art that due to odorous substances emitted from coloring agents or due to ozone from the electrophotographic printer, the operational environment deteriorated, or an adverse effect was incurred on the printing device and its components. Further, if any countermeasure against this were taken, there is a problem that a substantial expenditure and workload will incur.

SUMMARY OF THE INVENTION

In view of the foregoing problems associated with the prior art, an object of the invention contemplated is to provide a printing system that can be controlled and operated by a minimum number of operators, with its printing speed substantially improved by automating the processes of supplying expendable items and of replacing spent parts and components during operation of plural printing devices.

It is another object of the invention to provide a printing system that can be controlled and operated by a minimum number of operators, with its printing speed substantially improved by automating the cutting process of printed media after printing, as well as the postprocess thereafter.

It is still another object of the invention to provide for an improved operating environment for the above-mentioned printing system and its printing devices, with a reduced cost and a minimum workload.

In order to accomplish the foregoing objects of the invention, it is contemplated to provide common coloring agent handling means for supplying coloring agents to plural sets of printing devices.

Further, it is contemplated to provide common printing media handling means for supplying an appropriate printing media to plural printing devices, and printing media loading means for loading the appropriate printing media to each printing devices.

Still further, it is contemplated to provide common expendables handling means for supplying appropriate expendable items to plural printing devices, and expendables loading means to each printing devices.

It is also contemplated to provide means for cutting printed media after printing and collecting them from the printing devices, and common printed media handling means for transporting collected printed media to a post-process device.

Further, it is contemplated to provide means for removing expendable items from each printing device when they are spent, and common spent expendables handling means for transporting removed spent expendables to a common disposal/collection/recycle unit.

Still further, it is contemplated to provide waste collection means to each printing device for collecting contaminating substances such as non-printed coloring agents, paper dregs and the like, and provide common contaminating substance handling means for transporting collected contaminating substances from each printing device to a common disposal/recycle device.

It is further contemplated to provide common toxic product handling means for transporting toxic products such as foul odor products and ozone that are produced from coloring agents and during printing process to common toxic product neutralizing means or to a common disposal device.

The above-mentioned coloring agent handling means makes it possible for a single coloring agent supply station to supply coloring agents to plural printing devices. Thereby, since it is possible to supply coloring agents to the plural printing devices in batches, a workload of the operator required with respect to replenishing coloring agents to respective printing devices can be substantially reduced, thereby, reducing the number of operators.

The above-mentioned printing media handling means makes it possible for a single printing media supply station to supply printing media to plural printing devices. In addition, the printing media loading means automatically loads a supplied printing media in the printing device in such a manner ready for subsequent printing. Therefore, since plural printing devices can be supplied and loaded with each printing media in batches, a workload of the operator required with respect to loading the printing media can be eliminated, thus, substantially reducing the overall workload of and reducing the number of the operators.

The above-mentioned expendable items handling means makes it possible for a single expendables supply station to supply expendable items to plural printing devices. In addition, the expendable items loading means automatically loads expendables in the printing devices in such a manner ready for subsequent printing. Therefore, since the plural printing devices can be supplied and loaded with expendables in batches, a workload of the service persons or operators required with respect to loading of the expendable items can be eliminated, in consequence, substantially reducing the workload of and the number of service persons and operators.

The above-mentioned means for cutting and collecting the printed media, and the printed media handling means make it possible in conjunction to supply the printed media from plural printing devices to a single postprocess device. Thereby, a workload of the operator required with respect to collecting the printed media from the printing devices can be eliminated, in consequence, substantially reducing the workload of and the number of operators. In addition, a workload in the postprocessing required after cutting of the printed media can be substantially reduced.

The above-mentioned spent expendable items replacing and handling means make it possible to transport the spent expendable items collected from plural printing devices to a single disposal/collection/recycle unit which treats the spent expendable items in batches. Thereby, a workload of the service persons and operators required with respect to replacing and treatment of the spent expendable items can be substantially reduced, in consequence, reducing the number of the service persons and the operators.

The above-mentioned contaminating substance collecting means and its handling means in conjunction make it possible to transport the collected contaminating substances from plural printing devices to a single contaminating substance disposal/recycle unit. Therefore, a workload of the operator required in cleaning and disposing the collected contaminating substances can be substantially reduced, in consequence, reducing the number of the operators.

Finally, the above-mentioned toxic product handling means makes it possible to transport collected toxic products from plural printing devices to a single toxic product neutralizing means for neutralizing the collected toxic products in batches, thereby, these printing devices can be maintained in an improved operating environment at a reduced cost, at a lower associated workload.

BRIEF DESCRIPTION OF THE DRAWINGS

The present invention can be understood more clearly with reference to the accompanying drawings.

DETAILED DESCRIPTION

Figure 1:
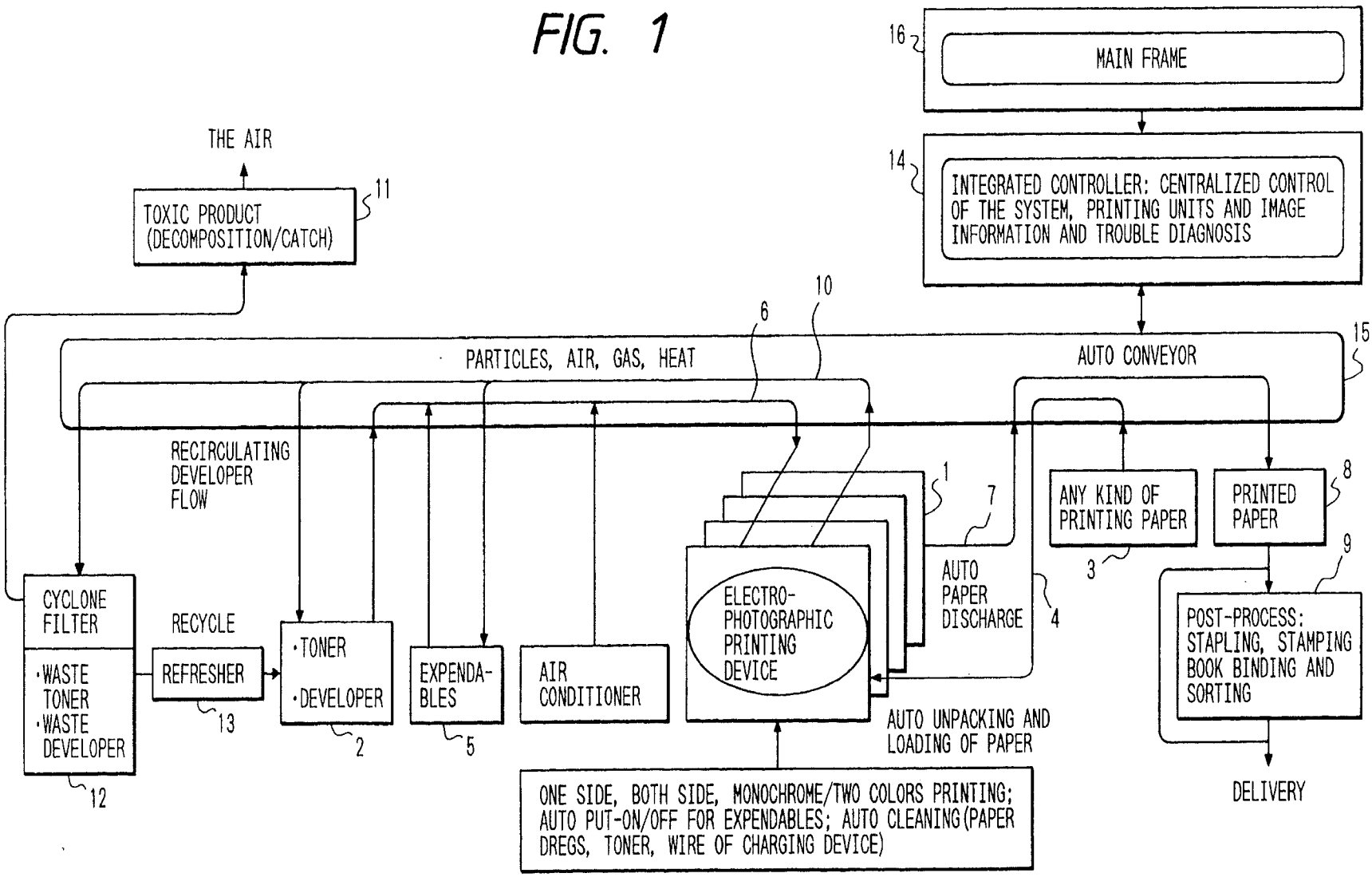
FIG. 1 is a block diagram illustrative of a schematic configuration and operation of a printing system according to an embodiment of the invention.

Now, with reference to FIG. 1, one preferred embodiment of the invention will be discussed in the following. FIG. 1 is a block diagram illustrating an overall schematic arrangement of a printing system and a function thereof according to the invention. In this printing system of the preferred embodiment of the invention, plural sets of printing devices are provided for use in combination which are based, for example, on an electrophotographic method. In the drawing, The elements are as follows:1; a printing station, 2; a coloring agent (toner or developing agents) supply station, 3; a printing media supply station, 4; printing media(printing paper, for example) handling means, 5; an expendables supply station, 6; supplies handling means, 7; printed media handling means, 8; a printed media stacker, 9; a post-process device, 10; discharge and transport means, 11; toxic product neutralizing means, 12; waste coloring agent collection means, 13; recycle means, 14; an integrated controller, 15; an information transmission bus, and 16; a main frame (large or small computer). Here, toner and developing agents are represented separately for allowing the latter to include the toner and a carrier (normally consisting of powders of iron or magnetic substances) which are needed in case of a two-component developer.

The printing station 1 as explained above comprises plural printing devices each adopting the electrophotographic process. Each printing device incorporates the above-mentioned printing media loading means, expendables (such as printing media, photoconductor) put-on/off means, spent expendables replace means, printed media cutting means, and printed media collecting means. The supplies handling means 6 comprises the above-mentioned coloring agent handling means and the expendables handling means. The discharge and transport means 10 comprises the above-mentioned spent expendables handling means, the contaminating substance transport means and the toxic product handling means.

First of all, the action and operation of the integrated controller 14 will be discussed in the following.

A mainframe 16 sends print information and a print instruction to the integrated controller 14 to assign any electrophotographic printing device in the printing station 1 to execute its print instruction. The print information includes the contents of an image, a specific layout of the image on a printing paper, a specific type of printing paper, a specified cutting pattern of the printed paper and the like. This print instruction, however, does not include information designating which electrophotographic printing device in the printing station 1 should perform its print instruction. The integrated controller 14 is connected to an information transmission bus 15, to which is input every information from every component device and means constituting this printing system. The component devices and means here refer to those devices and means indicated above by numerals 1 to 13. Upon receiving information from each component device and means indicative of each operating condition and the like, the integrated controller 14 produces management information therefor, and issues a control instruction to each component device or means according to the management information produced above.

The integrated controller 14 judges which one of the electrophotographic printing devices in the printing station 1 may be assigned properly to execute the print instruction from the main frame 16 according to the foregoing management information. At the same time, from the condition of the assigned electrophotographic printing unit, the integrated controller 14 determines operations of related component units which are required for execution of the print instruction, and issues respective execution instructions to the corresponding electrophotographic printing device and related component device or means. The information transmission bus 15 is adapted to provide a bidirectional information transmission and transmit respective execution instructions from the integrated controller 14 to respective component device or means. The integrated controller 14 is adapted not only to control the execution of printing, but also to monitor remaining quantities of coloring agents in the coloring agent supply station 2, printing media in the printing media supply station 3, expendables in the expendables supply station 5, printed media in the printed media stacker, and remaining life-cycles of expendables such as filters in the contaminating/toxic product neutralizing means 11. Then, the integrated controller 14 judges whether or not any replenishment, replacement or disposal work is needed, and issues respective work instructions to corresponding component devices or means when such is judged necessary. Further, if necessary, it informs the operator or service person of such necessities.

This printing system may be provided with a remote monitoring system such as a display panel or the like which can receive the management information from its integrated controller or its mainframe for use by the operators who are stationed remotely from the site of the printing system. Such a printing system allowing a remote monitoring as described above provides an advantage that a plurality of such printing systems located separately can be controlled and taken care of by a minimum number of operators and engineers.

Further, it is also possible to make up a system by adding to the integrated controller or mainframe communication means including a display panel and/or an oral annunciator which monitors respective devices or means and if needed requests, the expendables supply station to supply appropriate parts to the corresponding device. Further, through use of input means such as a keyboard or a mouse installed on the equipment, the system configuration can be adapted to cope with any changes in work instructions.

The integrated controller 14 further monitors inflow and outflow quantities of materials supplied and discharged in a series of flow, and controls such that the flow will not be blocked or interfered. For example, it supervises a process speed of the post-process device 9 and an effective printing speed in the printing station 1, and the quantity of the printed media in the printed media stacker 8. Then, if any overflow exceeding the capacity of the printed media stacker 8 is anticipated, it takes a measure to lower an effective printing speed of the printing station 1. In addition, it carries out any other flow management required and control of the system including the controls of a process speed of the recycle means 13, inflow and outflow contents of coloring agents to be disposed in the waste coloring agent collection means 12, and the flow of the coloring agent handling means.

In the next chapter, flows in this system of the coloring agents, printing media, expendables, contaminating and toxic products will be described in detail in the following.

Let's begin with replenishing of coloring agents. Each of a plurality of electrophotographic printing devices installed in the printing station 1 is provided with each developer for each color necessary for multiple-color printing, in most cases, with four colors including yellow, cyan, magenta and black. Each developer is provided with a detector for detecting a remaining toner quantity, and a result of detection is sent from the detector to a print controller provided in each electrophotographic printing device, where it is judged whether or not any supply of toner is necessary. Further, the print controller described above which monitors the printing condition and controls respective printing devices, has another function upon monitoring the operational conditions of respective printing devices and reports its result to the integrated controller. When it is identified that the remaining toners or developing agents in the coloring agent supply station are deplenishing, a supply command is issued to the operator via a warning device of the integrated controller. Informed of a necessity of replenishment of toners or developing agents, the operator loads the powder toners or developing agents for use in the electrophotographic printing devices into the coloring agent supply station 2. These toners or developing agents are transported through coloring agent handling means in the supplies handling means 6 toward the printing station 1, and in which they are distributed to each printing device for use in printing. Here, the coloring agent handling means is comprised of a pipe and a spiral screw installed in the pipe, the rotation of the screw causes transportation of the powder toners or developing agents. Transportation of the toners will be described more in detail. As described above, the toner quantity information on remaining toners in toner hoppers inside the developer installed in each printing device is constantly transmitted from the print controller through the information transmission bus 15 to the integrated controller 14. The integrated controller 14 judges an appropriate supply flow for the particular supply toners by integrating information transmitted from plural printing devices, and it sets an appropriate value of a rotating frequency per given period of time for the spiral rotor in the coloring agent handling means, and according to this set value it issues a screw rotation speed instruction to the coloring agent handling means via the information transmission bus 15. Thereby, an appropriate amount of toners is transported to the printing station 1. As to the distribution of toners to each printing device therein, an appropriate distribution of toners is carried out in response to a distribution instruction from the integrated controller 14 which monitors and controls necessary toner amounts in each printing device.

In the next step, replenishment of developing agents will be described. Each printing device constantly sends information on availability of its developing agents, i.e., an available printing quantity it can print until the end of the life-cycle of its developing agents (the life-cycle being determined from a charging condition of carriers) to the integrated controller 14 via the information transmission bus 15. On the basis of information on the available printing quantities until the ends of the life-cycles of developing agents sent from respective printing devices, the integrated controller 14 identifies a particular printing device which must be replenished with new developing agents. According to this identification, the identified printing device is caused to stop its printing operation temporarily, and discharge its spent developing agents which are then loaded on the contaminating substance transport means of the discharge and transport means 10. Immediately after that, a predetermined amount of new developing agent is supplied from the coloring agent supply station 2 to the corresponding printing device via the coloring agent handling means. In this instance, an appropriate screw rotation period of time for the screw of the coloring agent handling means is set on the basis of a predetermined quantity of developing agent to be replenished, thereby, a screw rotation instruction for the foregoing screw on the basis of the set value is issued to the coloring agent handling means via the information transmission bus 15. The foregoing coloring agent handling means has been described by way of example of the mechanical handling means, but it is not limited thereto, and any other means including a pipe transport method utilizing airflow may be adopted as well. In this instance, valves are attached to the pipe at respective branches leading to respective developers, and appropriate amounts of toners or developing agents are distributed by time-sharing through the valves by airflow control. In contrast to the foregoing screw type transport method, its control becomes sophisticated. However, advantageously, its construction becomes relatively simple, since its expendables required are only valves and so on.

Supply of printing media or printing paper will be described in the following. In response to a signal from the printing device in the printing station 1 notifying of a necessity of supplying printing paper, the integrated controller 14 judges whether or not the printing media supply station 3 has a stock of printing paper for replenishment, and if not, it notifies the operator by means of the warning signal sending device to supply the printing media supply station 3 with a new stock of paper. Informed of the necessity of supplying a new stock of printing paper, the operator replenishes the printing media supply station 3 with a new stock of paper. Printing paper thus replenished is transported to the printing station 1 through the printing media handling means 4, in which it is further delivered to the particular printing device which needs it. The printing paper thus delivered is set on the printing device by printing paper loading means installed inside each printing device such that it is ready for printing. This printing paper loading means comprises a retractable arm extendable in longitudinal directions, and a lifter and a robot hand both movable in vertical directions. The printing paper having been delivered by the printing media handling means 4 comprising, for example, a belt conveyor or roller conveyor is taken from the printing media handling means 4 into the printing device by the foregoing arm, and is set onto a printing paper transport roller inside the printing device by the robot hand. Upon completion of this setting, a set complete signal is issued to the print controller of the printing device to resume printing. As the printing media loading means for setting the printing paper ready for printing, the robot hand has been described by way of example, however, it not limited thereto, and any loading or setting means including such utilizing air suction may be adopted as well.

Each printing device constantly sends information on a remaining quantity of printing paper in its device to the integrated controller 14 through the information transmission bus 15. In collation of information on the remaining quantity of printing paper in each printing device sent as above, as well as printing information and a print instruction from the main frame 16, the integrated controller 14 determines a particular printing device which must be replenished with new printing paper, a particular type of printing paper to be replenished, and its quantity. Then, accordingly, a corresponding type and quantity of printing paper which satisfies the requirements is loaded onto the printing media handling means 4 from the printing supply station 3. Thereby, an appropriate printing paper is transported to the printing station 1, distributed to the predetermined printing device in need of such supply, and is set by the printing paper loading means installed inside each printing device in such a manner ready for printing. On the other hand, the printing paper having been printed is subject to cutting into a predetermined dimension by printed paper cutting means provided inside each printing device in response to an instruction from the integrated controller 14 on the basis of a printed paper cut specification given in the print information from the mainframe 16. This is done, however, only in such an instance when the printed information requires cutting into a particular dimension. Then, the printed paper is loaded on printed media handling means 7 by printed media collecting means, and is transported to a post-process device 9 through a printed media stacker 8. The printed paper having gone through the post-process is discharged out of this printing system. The printed media handling means 7 is comprised of a belt conveyor or a roller conveyor. The post-process device 9 is provided with functions of sorting, stapling, book binding and stamping, and which of the printed media should be applied which of these functions or should not is instructed wholly by the integrated controller 14 on the basis of a post-process specification given in the print information from the mainframe 16. The printed media stacker 8 temporarily keeps the printed paper in queue for post-process treatment. By way of example, those printed paper which does not need any post-process treatment is discharged directly from the printed paper stacker 8 out of this printing system. Those printed paper discharged out of the printing system directly from the printed media stacker 8 or from the post-process device 9 is sent to the subsequent process such as delivery. By way of example, although the subsequent process such as delivery is not incorporated into this printing system according to the invention, such a subsequent step may well be incorporated into the system. Although in the foregoing description, the remaining quantities of printing paper available in respective printing devices are identified by the corresponding information sent from respective printing devices, since the integrated controller 14 which issues print instructions to respective printing devices can learn by itself the amounts of consumption of printing paper in respective printing devices resulting from the print instructions given up to now, therefore, it is possible for the integrated controller 14 to issue a replenishment instruction based on its own judgment before receiving related information from the respective printing devices. Such an arrangement of the printing system will facilitate a high speed response and treatment since amounts of information flowing through the information transmission bus 15 can be reduced.

Replacing of expendables will be described in the following. Here, the expendables in the electrophotographic printing device refer to a photoconductor and a cleaner, or electrical parts such as a fusing device (heater) and a charger. In each printing device, its print controller always collects information on the remaining quantities of plural kinds of respective expendables present at plural positions inside the printing device, and sends information on its remaining printing quantity it can print until the life-cycle of respective expendables (or expendables life-cycle remaining print amount information) to the integrated controller 14 through the information transmission bus 15. On the basis of information on the expendables life-cycles and the remaining print quantities sent from respective printing devices, the integrated controller 14 identifies which printing device and which expendables are in need of replenishment, then according to its judgment, suspends the printing operation of the identified printing device, actuates its expendables take-off means to remove corresponding expendables the life-cycle of which has terminated, then loads the removed expendables on the spent expendables handling means of the discharge and transport means 10 to return to the expendables supply station 5. In the expendables supply station 5, such spent expendables among those returned which can be recycled through a simple cleaning operation or the like are subjected to an automatic recycle step, then, stored in the expendables supply station 5 as new expendables for reuse in the printing devices. Other spent expendables which cannot be recycled are discarded out of this system. On the other hand, corresponding new expendables to replace the spent expendables are transported to the printing station 1 through the expendables transport means of the supply handling means 6, and in the printing station 1 they are distributed to corresponding printing devices to serve for resumed printing. Here, the expendables transport means may be comprised of a belt conveyor or the like. Corresponding types of new expendables corresponding to supply instructions are loaded onto the expendables transfer means from the expendables supply station 5. Thereby, pertinent new expendables are transported to the printing station 1 in which they are distributed to respective predetermined printing devices. Any corresponding printing device after its expendables loading means having loaded the new expendables in response to an instruction from the integrated controller 14 resumes its suspended printing operation. Further, a shortage of replenishing expendables in the expendables supply station 5 is notified to the operator by an instruction from the integrated controller 14. Upon notification of the necessity of replenishment of particular expendables, the operator is urged to load it into the expendables supply station 5.

Now, disposal of contaminating substances will be described below. The contaminating substances here refer to non-printed toners floating in the air and paper dregs inside the printing device, the non-printed toners and paper dregs collected therefrom after cleaning, and the spent developing agents the life-cycle of which have expired. The contaminating substances collected inside the printing devices are directed to contaminating substance transport means of the discharge and transport means 10. This collection is carried out by suction of atmosphere inside the printing device. This air suction can be conducted constantly making use of cooling air flow circulating to prevent a temperature rise in the developing unit. Further, it can also be conducted using a suction blower attached as a power source to the waste coloring agent collection means 12. An instance by means of the waste coloring agent collection means 12 will be described in the following. That is, its contaminating substance transport means is an air duct and its transport method is by an airflow transportation. Thereby, the non-printed toners and paper dregs floating in the space inside the printing devices can be efficiently collected. Further, the non-printing toners and paper dregs discharged during a cleaning process can be sucked and carried to the contaminating substance transport means through a cleaning brush and its housing which are directly connected to a suction duct which extends into the printing device. As to the spent developing agents as well, they can be discharged to the contaminating substance transport means through a developing agent discharge port which is closable of the developer inside the printing device by opening the port, since which discharge port is directly coupled to a suction duct extending into the printing device. Open timing of the developing agent discharge port which is closable is the same as described above in regard of the coloring agent supply timing. There is provided a cyclone filter at the entrance of the waste coloring agent collection means 12, and the contaminating substances collected by the cyclone filter are retained in the waste coloring agent collection means 12. The contaminating substances retained in the waste coloring agent collection means 12 are carried to the recycle means 13 in which they are sorted into paper dregs, toners and carriers, of which the paper dregs are discharged outside the system. Since toners can be reused as sorted, they are sent to the coloring agent supply station 2 to serve for subsequent printing. Carriers are heated in a built-in high temperature furnace in the recycle means 13 to burn out fused toners (spent toners) from their surfaces, which have reduced the life-cycle of the carriers, then reactivated carriers are sent back to the coloring agent supply station 2 for subsequent printing service.

Disposal of toxic products will now be explained in the following. The airflow in the contaminating substance transport means described above also contains toxic products such as ozone generated in the printing devices since they are drawn in together. Strictly speaking, an exhaust air flow from the cyclone filter which is placed at the entrance of the waste coloring agent collection means 12 is a mixture of toxic products and the air. This cyclone filter exhaust air flow is sent to toxic product neutralizing means 11, where it is neutralized to become an intoxic air flow and is discharged out of the system. The toxic product neutralizing means 11 comprises a filter made of activated carbon which adsorbs ozone and other toxic aerosol substances.

There are so many advantages that can be accomplished by the present embodiment 1 according to the invention. Plural printing devices can be supplied with coloring agents in batches. Plural printing devices can be supplied and loaded with respective printing media in batches. Plural printing devices can be supplied and loaded with respective expendables in batches. It becomes possible automatically to supply printed media from plural printing devices to one post-process means through such means as a cutter for cutting printed media, a collecting device for collecting printed and cut media. It becomes possible to transport spent expendables from plural printing devices to a single spent expendable disposal/collection/recycle unit to be treated in batches. It becomes possible to transport contaminating substances from plural printing devices to the single contaminating substance disposal/recycle means to be treated in batches. It becomes possible to transport toxic products from plural printing devices to the single toxic product neutralizing means to be treated in batches. Thereby, since a greater part of the operators' workload can be eliminated, the number of operators needed in the operation and maintenance of the printing devices can be minimized. Further, work environments around the printing devices can be maintained clean and safe with reduced cost and least possible workload.

Next, with reference to FIG. 2, another embodiment of the invention will be described.

Figure 2:
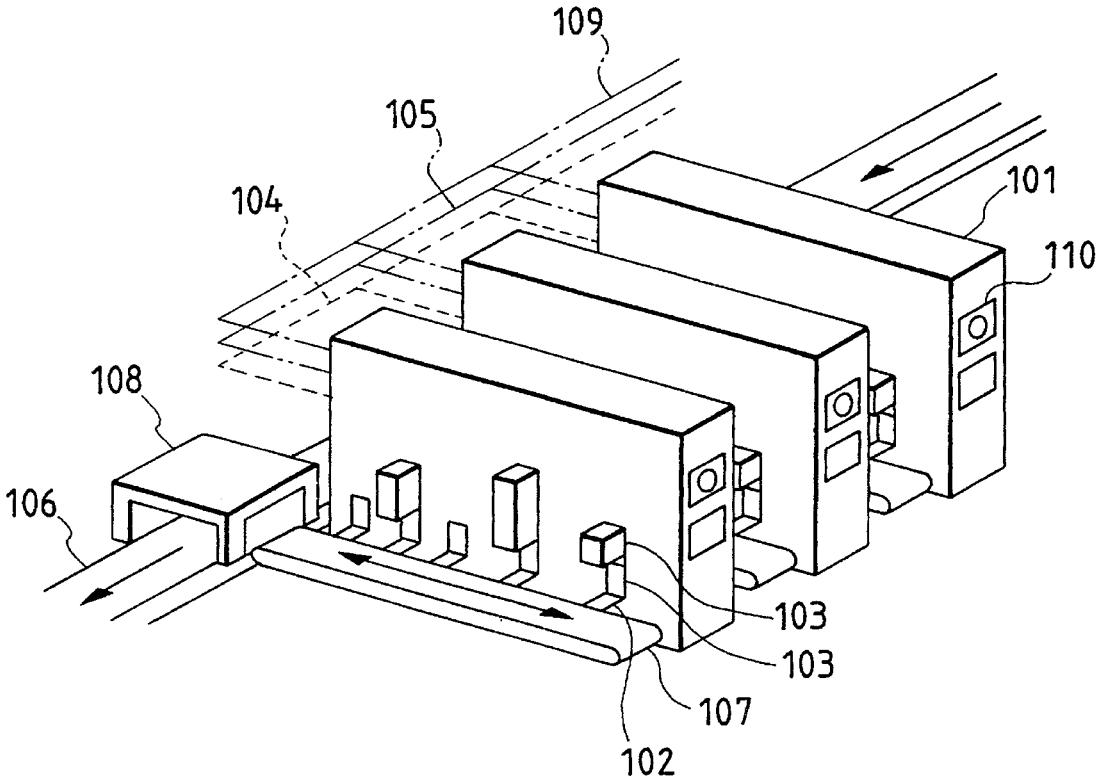
FIG. 2 is a perspective view of a printing station of the printing system of the present invention.

FIG. 2 is a perspective view of a printing station of a printing system according to the invention. Flows of materials such as coloring agents, expendables, contaminating substances, toxic products, and of information necessary for system operation are substantially the same as in the foregoing embodiment 1 of the invention. Numeral 101 is a large scale printing device, 102 is a material transport elevator, 103 is a material supply and disposal port, 104 is a first coloring agent supply duct, 105 is a second coloring agent supply duct, 106 is a main conveyor, 107 is a branch conveyor, 108 is a book-binding/post-process device, 109 is an ozone suction duct, and 110 is a warning signal sending device.

The large scale printing device 101 of the invention is an electrophotographic printing unit which integrates plural printing devices which have been described in the first embodiment described above. In this second embodiment of the invention, the large scale printing device 101 contains three sets of electrophotographic printing processes per unit. Thereby, since it is possible to apply plural electrophotographic printing processes with respect to a single printing media, its printing speed for printing in multicolors and on both surfaces can be substantially improved compared to the foregoing first embodiment of the present invention. Further, like the first embodiment, each of the electrophotographic printing processes in the large scale printing device 101 incorporates therein printing media loading means, expendables loading means, spent expendables removing means, printed media cutting means, and printed media collecting means. Supply materials such as printing media prior to printing, and new expendables are carried by a material elevator 102 and are supplied to the large scale printing device 101 through a predetermined material supply and disposal port 103. Discharge materials such as printed media and spent expendables are discharged from the material supply and disposal port 103 out of the large scale printing device 101, then, through the material elevator 102 they are carried through a discharge passage, i.e., a branch conveyor 107 in this embodiment. By way of example, one unit of the material elevator 102 may serve for two ports of the material supply and disposal port 103. In this embodiment, the material elevator 102 on the right-hand in FIG. 2 represents such an example.

The first coloring agent supply duct 104 and the second coloring agent supply duct 105 have the identical functions as the coloring agent transport means which have been described with respect to the first embodiment of the invention. In this second embodiment of the invention, the first coloring agent supply duct 104 transports a black color toner and its associated developing agent and carrier. Since this second embodiment is designed to perform a multicolor printing, there is also provided the second coloring agent supply duct 105 which transports color toners other than the black color and their associated developing agents and carriers.

The main conveyor 106 and the branch conveyor 107 have the identical functions as those in the first embodiment of the printing media handling means 4 and the printed media handling means 7, the expendables handling means, and the spent expendables handling means. Printing media and new expendables supplied from upstream of the main conveyor 106 are caused to diverge their direction of flow to a corresponding branch conveyor 107 associated with a corresponding electrophotographic printing process which needs replenishment. Further, printed and spent expendables having been carried by the branch conveyor 107 converge at the main conveyor 106 to be transported downstream of the main conveyor 106, where printed media are applied necessary treatments as described with respect to the first embodiment of the invention. Here, the bookbinding/post-process device 108 corresponds to the post-process device 9 described in regard of the first embodiment. Here, of those confluent materials being carried by the main conveyor 106, the printed media are subjected to required treatments such as sorting, stapling, book-binding, stamping and the like. Further, controlling of the supply, discharge and disposal is under the realm of administration of the integrated controller 14 like the first embodiment. The printing system of the second embodiment of the present invention does not have the printed media stacker 8 which has been described with regard to the first embodiment. Therefore, in consideration of a detected quantity of transport on the main conveyor 106, the speed of printing in each large scale printing device 101 is controlled such that the quantity of transport does not exceed a transport capacity of the main conveyor.

The ozone suction duct 109 has the identical function as the contaminating substance transport means described in regard of the first embodiment, and which draws in contaminating and toxic products such as ozone produced in the electrophotographic processes, floating non-printed toners and paper dregs to transport by air flow to likewise component devices as in the first embodiment, i.e., the waste coloring agent collection means 12, then, to the toxic product neutralizing means 11.

The warning signal sending device 110 corresponds to an I/O portion between the information transmission bus 15 which has been described with reference to the first embodiment and the large scale printing device 101. Exchange of information with the integrated controller 14 in this second embodiment, however, is performed by wireless.

According to the second embodiment described above, the same advantages obtained in the first embodiment can be accomplished, and in addition, further advantages coping with a variety of printing formats such as multicolor printing and both surface can be achieved, as well as high speed processing can also be implemented.

Still another embodiment of the invention will be described with reference to FIG. 3 in the following.

Figure 3:
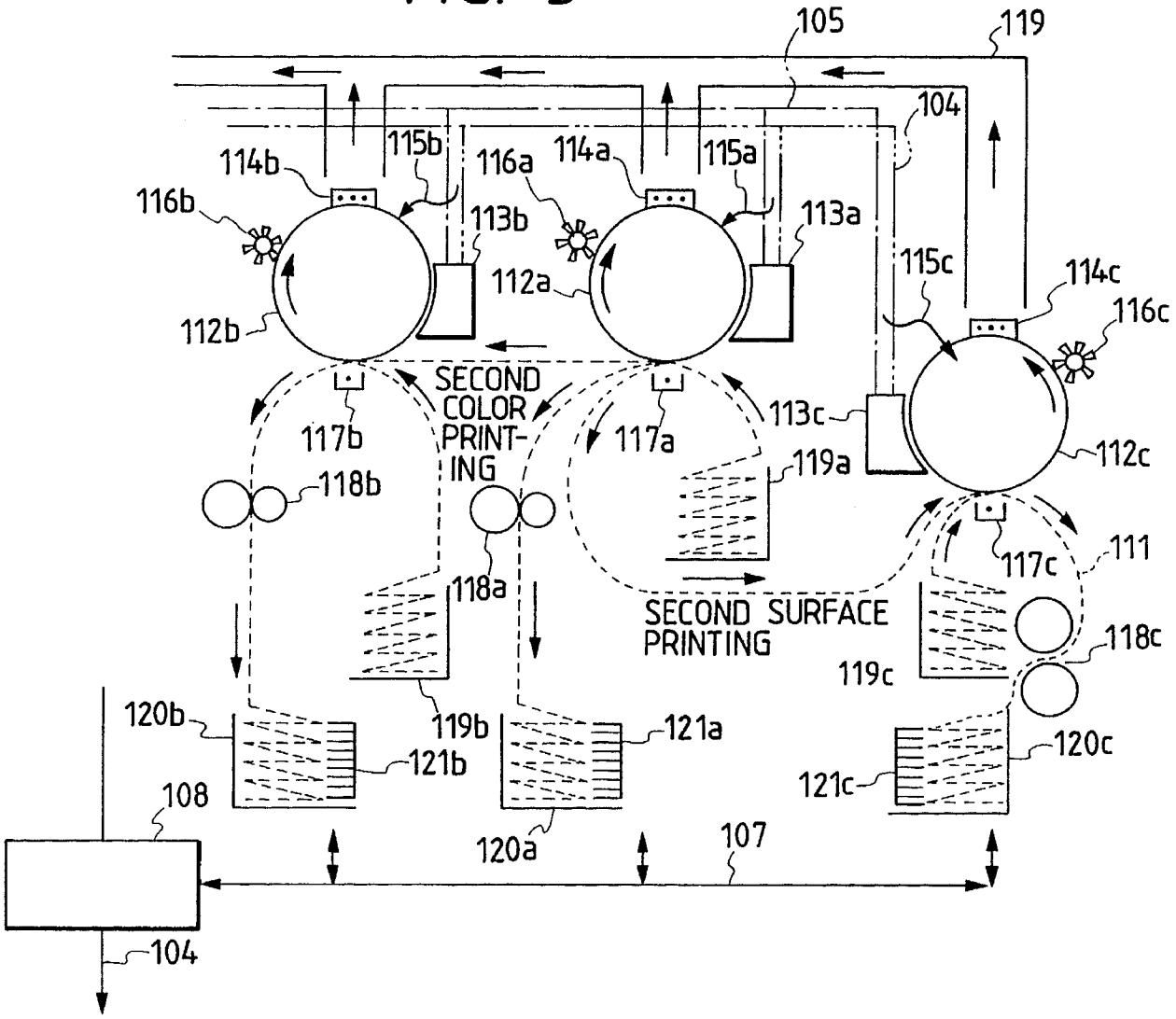
FIG. 3 is a schematic diagram of a cross-sectional view of a large scale printing device of the printing system of the present invention.

FIG. 3 is a cross-sectional view of a schematic diagram of a large scale printing device of a printing system of the still another embodiment of the invention.

Numerals in the drawing designate corresponding items as follows: 111 . . . sheet of printing paper, 112 with alphabetic suffix . . . photoconductor drum, 113 with alphabetic suffix . . . developing device, 114 with likewise suffix . . . charging device, 115 with likewise suffix . . . exposure process, 116 with likewise suffix . . . cleaning device, 117 with likewise suffix . . . image transferring device, 118 with likewise suffix . . . fusing device, 119 with likewise suffix . . . supply paper hopper, 120 with likewise suffix . . . printed paper stacker, and 121 with the likewise suffix . . . cutter. Other numerals in the drawing of FIG. 3 represent corresponding component devices as described in the drawing of FIG. 2. The large scale printing device according to the third embodiment of the invention combines three types of electrophotographic printing processes. A process located in the center in the drawing of FIG. 3 is defined as a process a, a process on the left-hand side of the drawing is defined as a process b, and a process on the right hand side of the drawing is defined as a process c. The alphabetic suffixes affixed to numerals corresponding to respective component devices correspond to respective alphabets affixed to respective processes described above, and indicate which device belongs to which process.

Each process carries out its printing by means of the electrophotographic process. After uniformly charging the surface of the photoconductor drum 112 by the charging device 114, a light beam is irradiated over the drum to form an imagepattern by the exposure process 115. Upon irradiation of light, the surface of the photoconductor drum 112 which was a non-conducting material prior to irradiation changes to an electric conducting material only at portions having been exposed to light, thereby, allowing retained electric charges to free therefrom. In this manner, an electric charge latent image is formed thereon. On the other hand, the toner inside the developing device 113 is charged by friction with its carriers. When the electric latent image on the surface of the photoconductor drum 112 is caused to contact with the foregoing charged toner, a large coulomb force acting between the light-exposed portion having reduced charges and the charged toner causes the charged toner to move from the developing device 113 to the surface of the photoconductor drum 112 to attach only to the exposed portion. In this way, an apparent image of attached toner is formed on the surface of the photoconductor drum 112. In the next step, an image transferring device 117 which generates a field of reverse polarity opposite to the polarity of the toner, through action of this field transfers the toner image from the photoconductor drum 112 to a printing paper 111. In this image transfer process, not all the toner on the surface of the drum 112 is transferred to the printing paper 111, but a small amount of the toner still remains on the surface of the drum. Therefore, the remaining toner must be wiped out from the surface by the cleaning device 116. On the other hand, a toner image on the surface of the printing paper which just has passed through the image transferring device 117 is still in an unfixed or unfused condition. Thus, the paper 111 carrying the unfused toner thereon is carried to the fusing device 118. The fusing device 118 fuses the unfused toner image on the surface of the paper 111 by heating and fusing it thereon. By way of example, the fusing device 118 which is comprised of two rotating press rollers of a heat roller which is heated to a predetermined temperature and a backup roller which supports the heat roller permits the paper 111 carrying the unfused toner image thereon to pass through its rotating press rollers such that the unfused toner image is fused and fixed.

Each electrophotographic printing process of the present embodiment of the invention can carry out its operation independently. In this independent operation, for example, in process a, a printing paper 111 being fed from a supply paper hopper 119*a* travels through an image transferring device 117*a* to a printed paper stacker 120*a*. In process b, a printing paper being fed from a supply paper hopper 119*b* travels through an image transferring device 117*b* to a printed paper stacker 120*b*. The likewise instance occurs in process c.

The large scale printing device according to the invention can perform a two color printing. In this instance, the process a and the process b are used in conjunction. A printing paper 111 fed from the supply paper hopper 119*a* forms a first color toner image thereon by means of the image transferring device 117*a*, then it is caused to travel not to its fusing device 118*a* but to the image transferring device 117*b* of the process b in which a second color image corresponding to the first color image is formed. Thus, the second color image is transferred onto the surface of the printing paper 111 therein. At this time, the first and the second color images on the printing paper are not fixed, therefore, they are fused simultaneously in the fusing device 118*b*, then the paper with fused images arrives at the printed paper stacker 120*b*. During this printing operation, the process c does not need to stop its operation, but can print other image information independently. It is also possible to arrange such that the process a forms the second color toner image and the process b forms the first color toner image.

According to the large scale printing device of the present embodiment of the invention, the paper 111 can be printed on both sides thereof. In this instance, the process a and the process c are used in conjunction. A sheet of paper 111 fed from the supply paper hopper 119*a* forms a first surface toner image on a first surface thereof by the image transferring device 117*a*, then it is guided not to its fusing device 118*a* but to the image transferring device 117*c* where a second surface toner image is being formed for a corresponding second surface thereof. In this image transferring device 117*c*, the second surface toner image is transferred onto the second surface of the paper 111 opposite to the surface having the first surface toner image. At this instance, the toner images on both the first and the second surfaces are not fused. Therefore, in the fusing device 118*c*, both images on both the surfaces are fused simultaneously, then the printed paper arrives at the printed paper stacker 120*c*. During this printing operation in conjunction of the process a and the process c, the process b need not stop its operation, and can carry on its printing according to another image information independently. By way of example, since it is necessary for the fusing device 118*c* to carry out simultaneous fusing of the both surfaces, both the heat roll and backup roll are heated.

As already described above, the first coloring agent supply duct 104 and the second coloring agent supply duct 105 are coupled through their ports to respective developing devices 113*a*, 113*b*, 113*c* of respective electrophotographic printing processes so that a pertinent coloring agent is supplied on request. Further, respective suction ports of the ozone suction duct 109 are positioned immediately above respective charging devices 114*a*, 114*b*, 114*c* of respective electrophotographic printing processes so that contaminating and toxic products such as ozone, floating waste toner, and paper dregs produced in each process may be drawn into the duct to be transported by airflow. The reason why the suction ports of the ozone suction duct 109 are positioned directly above the charging devices is because that the charging devices 114 produce most of the toxic product of ozone. Further, respective printed paper stackers 120*a*, 120*b*, 120*c* are provided with a cutter 121*a*, 121*b*, 121*c*, thereby, printed paper 111 is cut into any size and format as required. The flow of printed paper 111 after cutting is the same as in the embodiment 2 of the invention described above.

Further, any control of printing, cutting, supplying and handling described above is administered by the integrated controller 14 as in the first embodiment of the invention.

According to the third embodiment of the invention described above, there is such an advantage, in addition to the advantages obtained by the first and the second embodiments of the invention, that while carrying out a multicolor printing or both side printing, another printing in response to another image information can be executed independently. Further, since the fusing process for the multicolor printing or both side printing can be performed in a single process, a saving in electrical power can be attained as well.

Now, with reference to FIGS. 4 and 5, one embodiment of a control device and its method for managing and controlling plural printing stations will be described. This control method has been contemplated significantly to improve the reliability of the printing system.

Figure 4:
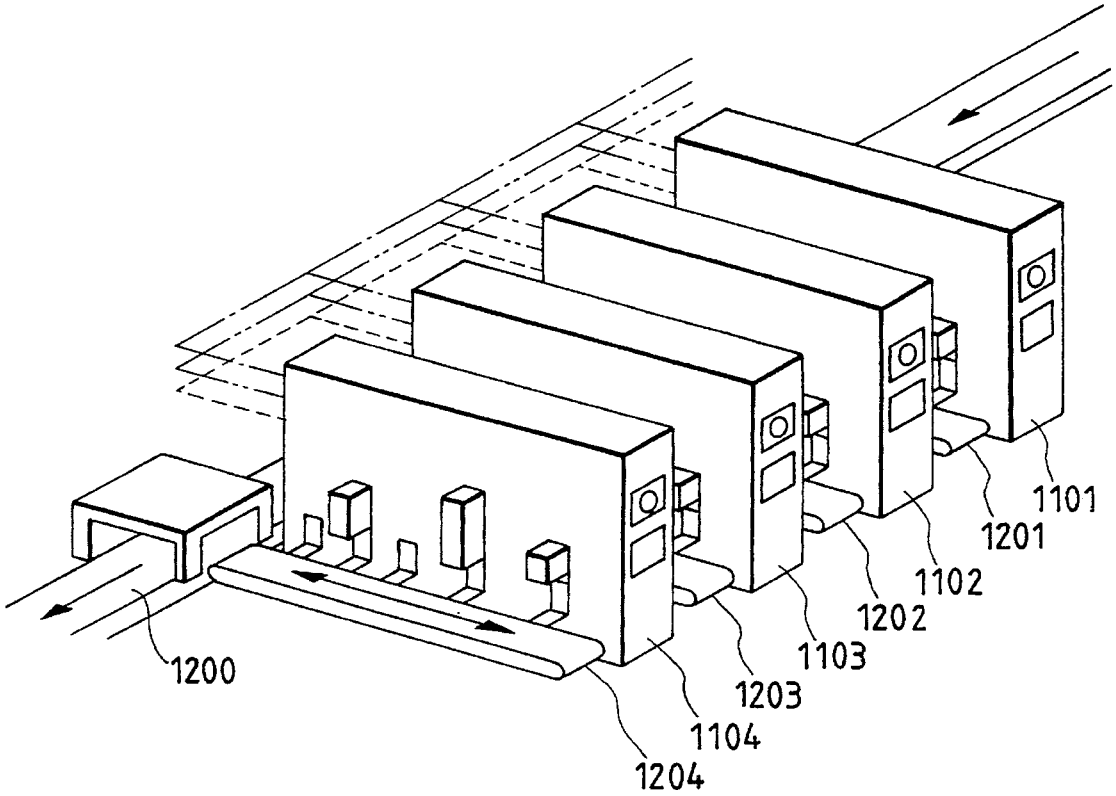
FIG. 4 is a perspective view of a printing station of the printing system of the invention.
Figure 5:
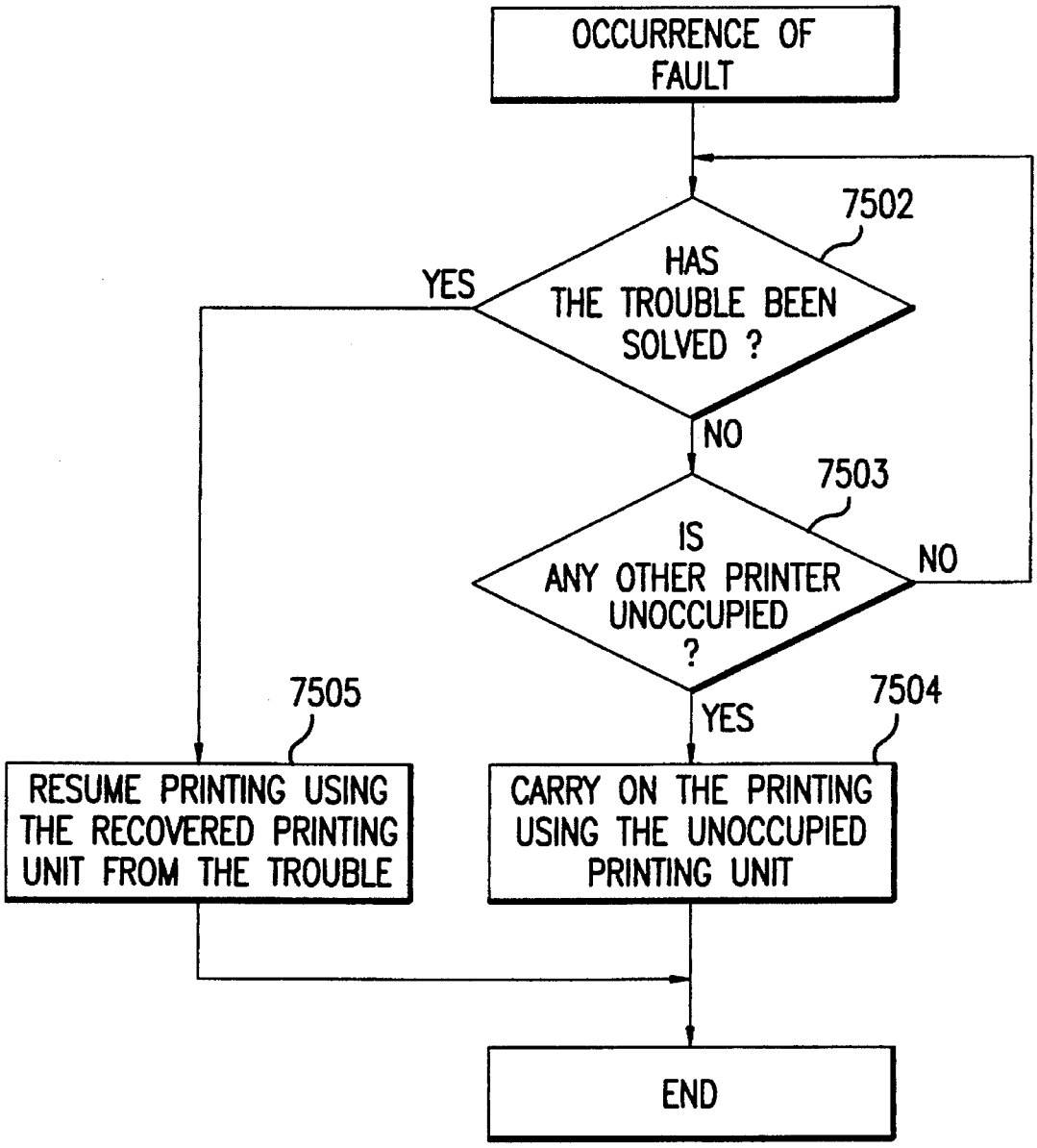
FIG. 5 is a flowchart of troubleshooting control procedures for the printing system of the invention.

FIG. 4 is a perspective view of a printing station according to the present embodiment of the invention, and FIG. 5 is a flowchart indicating its trouble-shooting control procedures.

This control system for the printing station 1 comprising plural large scale printing devices ensures that even when any one of its plural large printing devices fails or stops its operation due to malfunction or maintenance work, another one is adapted to carry out the printing in place of the failed unit, and thus continues the printing without interruption.

The printing station according to the present embodiment of the invention of FIG. 4 is identical with the printing station 1 of FIG. 1 provided that the printing station 1 includes four sets of the large scale printing devices 1001, 1002, 1003, 1004. Suppose that while a large scale printing device, for example, 1001 is printing JOB1 print information, one of its components or parts, for example, a gear fails, thus suspending its print operation. A control method to cope with such failure will be described in the following. This failure information is transmitted from the printing station 1 to the integrated controller 14 via the information transmission bus 15. Upon detection and notification of any failure in the large scale printing device 1001, the integrated controller 14 which monitors the condition of each one of the large scale printing devices in the printing station 1 causes either one of the large scale printing devices 1002, 1003, 1004 other than the failed printing device 1001 to resume the JOB1 printing in place thereof. If all of the other large scale printing devices are busy in printing their own assignment JOB of other print information, printing of JOB1 will be put in a queue to be accomplished after any one of them finishes its printing. However, if the failed large scale printing device 1001 is recovered to normal before any other printing device starts printing JOB1, it will resume the printing of JOB1.

The troubleshooting control procedure described above is summarized in FIG. 5. In an event of a trouble, in a judgment process step 7502, it is judged whether or not the trouble is solved. Although this judgment process step 7502 is not necessary immediately after the occurrence of a trouble, it becomes necessary should the trouble be solved sooner and for judging whether to allow the printing device which was in trouble but appears to have recovered to resume its printing operation. When this judgment process step 7502 judges that the trouble is not solved, a subsequent judgment process step 7503 checks the conditions of the other large scale printing devices and judges whether or not there exists any unoccupied large scale printing device which is not carrying out printing. If there is any unoccupied unit, at a process step 7504, a suspended printing task is assigned to this unoccupied printing device to carry out on behalf of the troubled unit, and in case where there exist no unoccupied large scale printing device, a loop of judgment processes from step 7502 to step 7503 is executed in repetition until any one of these printing devices becomes free. During execution of this loop, should the troubled printing device recover from its trouble, the flow diverges from step 7502 to step 7505 whereby to enable resumption of the suspended printing by the printing device which has recovered from its trouble. In case any other large scale printing device becomes unoccupied earlier than the recovery of the troubled unit, the interrupted printing task is caused to be carried out by this unoccupied printing device in step 7504. According to these control procedures described above, a continuous printing operation without interruption becomes possible even if there occurs any trouble in the large scale printing units.

Reassignment of the printing task without causing interruption has been described heretofore by way of example of occurrence of some trouble with a printer, however, it applies likewise to such an occasion where any one of the large scale printing devices becomes unavailable due to maintenance.

A highly reliable printing system can be realized by controlling the printing station 1 as described above, in which even if any one of the plural large scale printing devices in the printing station should fail, its print task may be reassigned to any other substitute to be carried out on behalf of the failed one. Heretofore, the present embodiment of the invention has been described by way of example of the control method for enabling a substitute printing among the plural large scale printing devices in the printing station, but it is not limited thereto, and it may be applied likewise to a substitute printing between respective electrophotographic processes in any large scale printing device.

Now, again with reference to FIG. 1, a control method for enhancing a quick response while minimizing the electric power consumption according to this embodiment of the invention will be described in the following.

Respective electrophotographic printing devices which constitute the printing station 1 utilize a fusing device of heat-roll type. In order to ensure an adequate fusing to be performed, it is necessary to raise the temperature of any heat-roll to a predetermined temperature, therefore, printing by the heat-roll will not start until it reaches the predetermined temperature. This naturally results in a time lag for the print information which has been sent to the integrated controller 14 to be actually printed out. In order to minimize such time lag, it may be conceived that the heat-roll is always maintained at the predetermined temperature. To apply such control to every electrophotographic devices in the printing station 1 so that their heat-rolls are maintained at the predetermined temperature will, in turn, increase electric power consumption. Therefore, such control methods according to the invention as will be described below are applied to the printing station 1.

A first control method of the invention comprises maintaining the heat-roll of a single particular device among the plural electrophotographic printing devices at the predetermined temperature during standby. Then, when any print information is sent from the mainframe 16 to the integrated controller 14, the integrated controller 14 enables the particular electrophotographic printing device in the printing station 1 the heat-roll of which is maintained at the predetermined temperature necessary for fusing to execute the printing of that print information. By this control method, it becomes possible immediately to start a printing operation as well as minimize the electric power consumption.

A second control method of the invention comprises the steps of constantly monitoring by means of the integrated controller 14 the temperatures of every heat roll in every electrophotographic printing devices in the printing station, and selecting a particular one of the plural electrophotographic printing devices the heat roll of which has a temperature nearest to the predetermined temperature necessary for fusing, or the temperature of which can be raised to the predetermined temperature in a shortest period of time. Since this control method results in selecting the most appropriate electrophotographic printing device which can be put into service the quickest, it becomes possible to enhance a speedier printing such as in the first control method. Further, according to this control method, it becomes possible also to minimize the electric power consumption required for raising the heat roll to the predetermined temperature.

Through the above-mentioned control methods of the invention, it has become possible advantageously to enhance the quick response of printing as well as minimize the electric power consumption.

Still another embodiment of the invention will be described in the following.

A printing system according to this still another embodiment of the invention has a system arrangement as shown in FIG. 4 which is provided with a plurality of large scale printing devices each having a printing station 1 of FIG. 3. The advantage of this printing system which allows, for example, execution of a versatile type of printing will be described in the following. With this system arrangement using a plurality of large scale printing devices in conjunction, a printed media printed with first print information in one large scale printing device is transported to another large scale printing device by means of handling means, whereby to be printed with second printing information such that a plurality of pieces of print information are printed on the same printing media. The large scale printing device of FIG. 3 comprises three sets of the electrophotographic printing processes, and thus a single unit thereof can print a monochrome printing, two-color printing and both side printing in conjunction of these three processes. Further, by using a plurality of these large scale printing devices in conjunction, a both side two-color printing or three-color printing becomes possible in addition to the above-mentioned versatile printing. The foregoing versatile printing features can be attained by combining two units of the large scale printing device.

In the case of a backside two-color printing, a two-color print is applied on one surface side of a printing media, at first, in a large scale printing device 1101. Then, the printing media printed on the one surface side thereof is carried to the main conveyor 1200 via a branch conveyor 1201, then, to another branch conveyor 1202 to be delivered to another large scale printing device 1102, in which another two-color printing is applied on the other surface side of the printing media to provide the both surface side two-color printing. In the case of a triple-color printing, a specific large scale printing device which is capable of printing in a color different from that of the large scale printing device 1101 is selected to provide additional printing in a third color on the same surface side of the printing media delivered therein on which the two-color printing has been already applied.

In the same manner as above, by arranging such that large scale printing devices 1103, 1104 are adapted to print image information in a color different from those of the large scale printing devices 1101, 1102, a both side three-color printing, a single side four-color printing or a both side four color printing can be accomplished.

Figure 6:
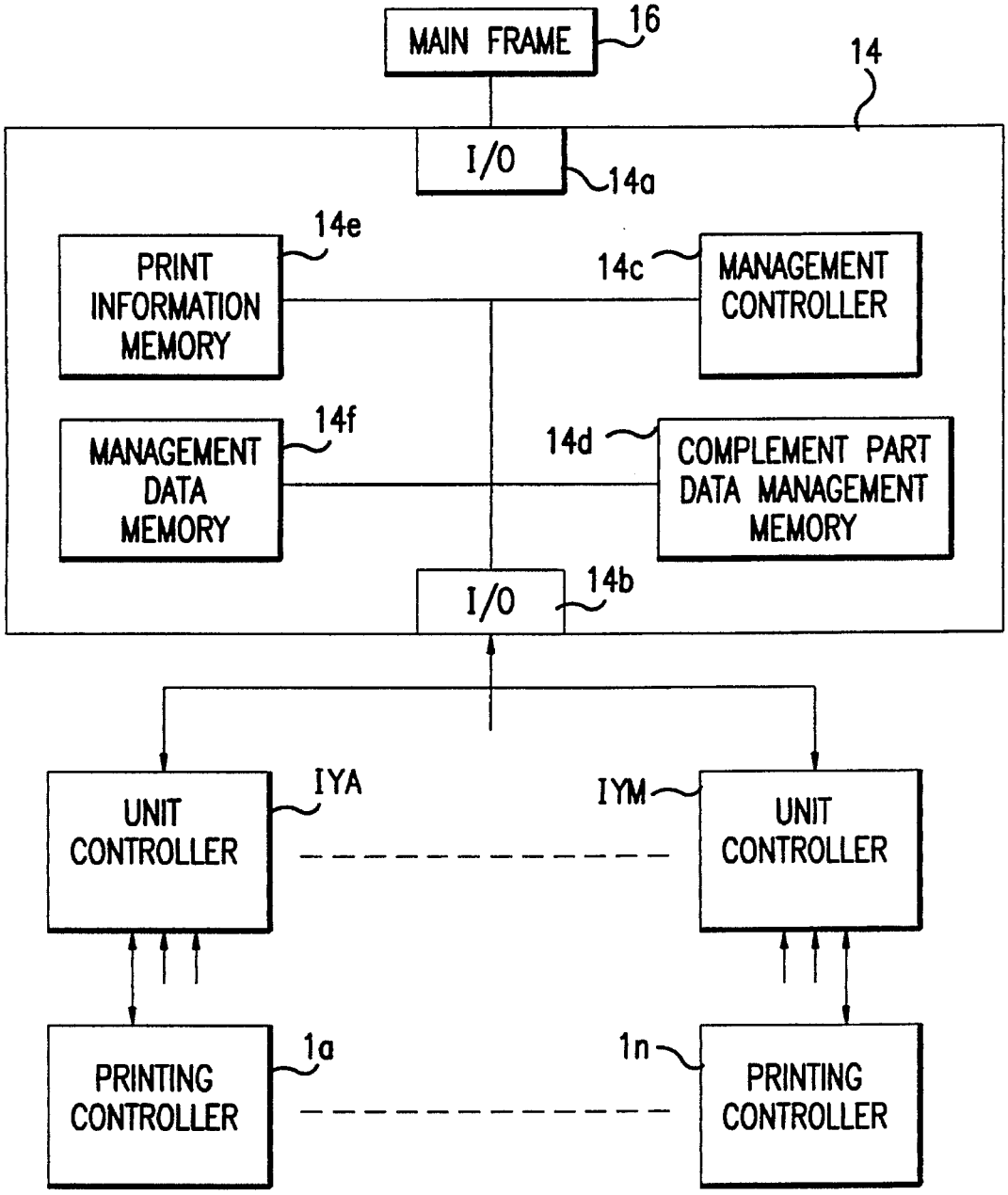
FIG. 6 is an example of a control system configuration of the invention.

With reference to FIG. 6, there is shown a schematic block diagram of the control device according to the present invention. This schematic diagram illustrates an arrangement of the controller for use in the system configurations of FIGS. 2 and 5.

A mainframe (main computer) 16 produces print information to be printed, receives print information from external devices and sends it to the integrated controller 14. The integrated controller 14 receives print information from the mainframe 16 through an input/output terminal 14*a*, and also receives management information indicative of status of respective printing devices from respective unit controller 1YA, . . . , 1YM through an input/output terminal 14*b*. In this drawing of FIG. 6, only one mainframe is shown, however, it is not limited to one, and a plurality of mainframes may be connected via a communication network. The print information received from the mainframe is stored in print information memory 14*e*. Further, a management controller 14*c* in the integrated controller 14 which fetches data indicative of operational status of respective printing devices from a management data memory 14*f* determines which printing device should carry out printing of the forwarded print information according to a type of its print information and its quantity. In addition, the integrated controller 14 receives information on expendables in the printing devices in each unit via unit controllers 1YA, . . . , 1YM, and stores its information in a component part data management memory 14*d*. The management controller judges the lifecycles of various components and parts in each printing device on the basis of the management data stored in the component part data memory 14*d*, determines whether or not a particular replenishment is required, and issues a supply instruction to a corresponding supply mechanism and a corresponding unit control device.

Further, in the case when it is judged that a particular type of expendables or components must be supplied from outside, that is, when corresponding supply components or expendables are not immediately available from the expendable supply station, the warning signal sending device notifies the operator or the supplier.

The unit controller 1YA, . . . , 1YM is a small version of the integrated controller 14, which receives print information from the integrated controller, and also operation information of each printing device and status information on respective expendables from a printing controller 1*a* . . . 1*n* provided in each printing device within the unit, then identifies a most suitable printing device which will be able to carry out the outstanding printing, then transmits its information to a corresponding printing device. Further, component part and expendables information in each printing device is summarized as a management data to be entered into a management data table which is then transmitted to the integrated controller. The printing controller receives detected information indicative of the conditions of each component and part in its printing device and of a quality of print as detected by each detector, then produces control information for controlling versatile devices according to the detected information and issues a control instruction therefor, followed by transmission of the status information on each component and part to the unit controller. Further, the printing controller carries out such operation as converting print information into dot data and the like.

Such a hierarchical configuration of the control system according to the present invention can alleviate a burden imposed on each control device, facilitate a high speed printing operation, and in addition, readily provide a system enhancement capable of flexibly reengineering or restructuring the control system in the future.

According to the subject invention described above, there is such an advantage that since a single toner port in conjunction with coloring agent handling means is adapted to supply a coloring agent to a plurality of printing devices, it becomes possible to supply any coloring agent to a plurality of printing devices in batches, thereby, substantially reducing the work load of the operator relating to replenishment of coloring agents, in consequence, minimizing the number of the operators.

Further, according to the subject invention described above, there is such an advantage that since a single printing media supply port in conjunction with printing media handling means is adapted to supply a printing media to a plurality of printing devices, and in addition, since the printing media loading means is adapted automatically to load the printing media into the printing device in a condition ready for printing, it becomes possible to supply and load the printing media into a plurality of printing devices in batches, thereby, eliminate the work load of the operator required in replenishing the printing media, and in consequence minimize the number of operators.

There is still another advantage according to the invention that since the expendables handling means can supply expendables to a plurality of printing devices through a single expendable supply port, and since their respective expendable loading means automatically can load delivered expendables on respective printing devices in a condition ready for printing, it becomes possible to supply and load expendables on a plurality of printing devices in batches, thereby, eliminating the workload of the operator or service engineer with respect to replenishing expendables, in consequence, minimizing the number of the operators and service engineers.

There is still further advantage according to the invention that since the cutting and collection means of printed media, and the printed media handling means in combination can supply the printed media from a plurality of printing devices to a single post-process device, it becomes possible to eliminate the workload of the operator to collect the printed media from the printing devices, thereby, minimizing the number of operators. There is still another advantage that the workload required in the post-process with respect to cutting of the printed media can be substantially reduced.

There is still more advantage according to the invention that the spent expendable removal means and the spent expendable transport means in conjunction make it possible to transport respective spent expendables from the plurality of printing devices to a single spent expendables disposal/collection/recycle means in which the collected spent expendables can be treated in batches, thereby, the workload of the operators and service engineers with respect to removal and disposal of the spent expendables can be reduced substantially, and in consequence, the number of the service engineers and operators can be minimized.

There is still another advantage that the contamination substance collection means and its transport means in conjunction make it possible to transport respective contamination substances from the plurality of printing devices to a single contamination substance disposal/recycle device, thereby, the workload of the operators with respect to the cleaning and treatment of the contamination substances can be reduced substantially, in consequence, minimizing the number of the operators.

There is furthermore advantage that the toxic products discharge and transport means makes it possible to transport respective toxic products from the plurality of printing devices to a single toxic product neutralizing device or disposal device for neutralizing or disposing the toxic products, thereby, it becomes possible to maintain a clean environment during operation of the printing devices at a reduced cost and the least possible workload.

Finally, there is still another advantage that the hierarchical configuration of the control system according to the invention provides a flexible system enhancement.

What is claimed is:

1. A printing system comprising:

at least two printing devices each of which print an image on a surface of a printing media using a coloring agent;

an expendable supply station which is provided separate from said at least two printing devices and supplies expendables to portions in each one of said at least two printing devices which need such expendables;

a supplies handler that transports said expendables from said expendable supply station to any one of said at least two printing devices;

a replacement mechanism provided in each of said at least two printing devices that replaces spent expendables with a new expendable received from said supplies handler;

a discharge station from which spent and replaced expendables are discharged;

spent material handler that transports spent expendables from said printing devices to said discharge station; and a controller that monitors, instructs and controls each operation at said portions therein wherein each printing device receives a respective image from said controller.

2. The printing system according to claim 1, further comprising a detector detecting an abnormality in any printing device so that in an event when printing is disabled due to an abnormality in a particular printing device while said control device is operating said particular printing device to print an image on a printing media, said control device instructs another printing device to execute the disabled printing.

3. A printing system comprising:

at least two printing devices each of which print an image on a surface of a printing media using a coloring agent;

an expendable supply station which is provided separate from said at least two printing device and supplies expendables to portions in each one of said at least two printing devices which need such expendables;

a supplies handler that transports said expendables from said expendable supply station to any one of said at least two printing devices;

a replacement mechanism provided in each of said at least two printing devices that replaces spent expendables with a new expendable received from said supplies handler;

a discharge station from which spent and replaced expendables are discharged;

spent material handler that transports spent expendables from said printing devices to said discharge station; and a controller that monitors, instructs and controls each operation at each portion of the system;

wherein said discharge station includes a disposal that treats the spent expendables transported thereto.

4. A printing system comprising:

at least two printing devices each of which print an image on a surface of a printing media using a coloring agent;

an expendable supply station which is provided separate from said at least two printing device and supplies expendables to portions in each one of said at least two printing devices which need such expendables;

a supplies handler that transports said expendables from said expendable supply station to any one of said at least two printing devices;

a replacement mechanism provided in each of said at least two printing devices that replaces spent expendables with a new expendable received from said supplies handler;

a discharge station from which spent and replaced expendables are discharged;

spent material handler that transports spent expendables from said printing devices to said discharge station; and a controller that monitors, instructs and controls each operation at each portion of the system;

wherein said supplies handler or said spent material handler comprises a distribution/collection mechanism positioned before a passage to said at least two printing devices and enabling a distribution of supplies for each printing device and a batch collection of spent expendables therefrom.

5. A printing system comprising:

at least two printing devices each of which print an image on a surface of a printing media using a coloring agent;

a printing media supply station supplying a printing media which is disposed separate from said at least two printing devices;

printing media handler transporting said printing media from said printing media supply station to said at least two printing devices;

a printing media loader provided in each of said at least two printing devices that loads and sets said printing media to each of said printing devices;

a printed media discharge station that discharges printed media which have been printed in said at least two printing devices;

a handler transporting the printed media from said printing device to said printed media discharge station;

a post-process function provided in said printed media discharge station, including cutting sorting, bookbinding of said printed media; and a control device which instructs each operation at each portion in each of said at least two printing device and related means wherein said image is sent from said control device to said printing devices.

6. A printing system comprising:

at least two printing devices each of which print an image on a surface of a printing media using a coloring agent;

a collector provided for each of said at least two printing devices for collecting contaminating substances which are produced in each printing device during its operation;

at least one contaminating substance treatment device provided outside said at least two printing devices; and a contaminant transport device that moves said contaminating substances from said each of the at least two printing devices to said at least one treatment device, said contaminating substances from a plurality of printing devices being transported to the treatment device by said transport device through a collecting duct provided outside respective printing devices.

7. A printing system having a plurality of printing units, each printing unit including at least two printing devices, each printing device printing an image on a surface of a printing media using a coloring agent, comprising:

an expendable supply station which supplies expendables to each printing device that constitutes said each printing unit, the expendable supply station being provided separate from said printing devices;

an expendables handler provided between said printing devices and said expendables supply station to transport expendables;

a replacement mechanism replacing expendables for said printing devices which is provided for each printing unit;

a waste transporter transporting spent expendables which have been replaced by said replacement mechanism;

a discharge station which discharges spent expendables transported by said waste transporter; and a control device which controls operation of each part in said devices and which provides an images for printing to the printing devices.

8. The printing system according to claim 7 wherein said control device comprises:

a printing controller provided for each printing device and recording a printing condition thereof, a unit controller provided for each unit and determining which printing device to be used, and an integrated controller controlling respective units in an integrated mode.

* * * * *

UNITED STATES PATENT AND TRADEMARK OFFICE

CERTIFICATE OF CORRECTION

PATENT NO. : 5,548,375

DATED : 20 August 1996

INVENTOR(S) : Teruaki MITSUYA et al.

It is certified that error appears in the above-identified patent and that said Letters Patent is hereby corrected as shown below:

ON THE COVER Page, [54], line 2: Change "MAINTENANCE FREE" to --MAINTENANCE-FREE--.

IN THE ABSTRACT, line 13: After "thereby" delete ",".

| Column | Line | |
|---|---|---|
| 1 | 2 | Change "MAINTENANCE FREE" to --MAINTENANCE-FREE--. |
| 1 | 36 | Change "devices" to --device--. |
| 1 | 66 | After "tures" insert --,--; after "filters" insert --,--. |
| 2 | 58 | Change "devices" to --device--. |
| 2 | 62 | Change "devices" to --device--. |

UNITED STATES PATENT AND TRADEMARK OFFICE

CERTIFICATE OF CORRECTION

PATENT NO. : 5,548,375
DATED : August 20, 1996
INVENTOR(S) : Teruaki Mitsuya, et. al.

It is certified that error appears in the above-indentified patent and that said Letters Patent is hereby corrected as shown below:

| Column | Line | |
|---|---|---|
| 3 | 25 | After "thereby" delete ",". |
| 3 | 34 | After "thus" delete ",". |
| 3 | 41 | After "manner" insert --as to be--. |
| 3 | 66 | After "consequence" delete ",". |
| 4 | 8 | After "consequence" delete ",". |
| 4 | 13 | After "batches" change "," to --;--. |
| 4 | 23 | After "invention" change ";" to --.--. |
| 4 | 47 | Change "The" to --the--; change "1;" to -- 1 - --; change "2;" to -- 2 - --. |
| 4 | 49 | Change "3;" to -- 3 - --; change "4;" to -- 4 - --; change "media(printing" to --media (printing--. |

UNITED STATES PATENT AND TRADEMARK OFFICE

CERTIFICATE OF CORRECTION

PATENT NO. : 5,548,375

DATED : 20 August 1996

INVENTOR(S) : Teruaki MITSUYA et al.

It is certified that error appears in the above-identified patent and that said Letters Patent is hereby corrected as shown below:

| Column | Line | |
|---|---|---|
| 4 | 50 | Change "5;" to --5 - --. |
| 4 | 51 | Change "6;" to --6 - --; change "7;" to -- 7 - --. |
| 4 | 52 | Change "8;" to --8 - --; change "9;" to --9 - --. |
| 4 | 53 | Change "10;" to --10 - --; change "11;" to --11 - --. |
| 4 | 54 | Change "12;" to --12 - --. |
| 4 | 55 | Change "13;" to --13 - --; change "14;" to --14 - --; change "15;" to --15 - --. |
| 4 | 56 | Change "16;" to --16 - --; change "main frame" to --mainframe--. |

UNITED STATES PATENT AND TRADEMARK OFFICE

CERTIFICATE OF CORRECTION

PATENT NO. : 5,548,375

DATED : 20 August 1996

INVENTOR(S) : Teruaki MITSUYA et al.

It is certified that error appears in the above-identified patent and that said Letters Patent is hereby corrected as shown below:

| Column | Line | |
|---|---|---|
| 5 | 34 | Change "main frame" to --mainframe--. |
| 6 | 2 | After "mainframe" insert --a--. |
| 6 | 3 | Before "oral" delete "an". |
| 6 | 5 | After "requests" delete ",". |
| 6 | 13 | After "interfered" insert --with--. |
| 6 | 23 | After "disposed" insert --of--. |
| 6 | 52 | After "1," delete "and". |
| 6 | 56 | Change "causes" to --causing--. |
| 7 | 33 | After "replenished" change "," to --;--. |
| 8 | 12 | After "example" change "," to --;--; after "it" insert --is--. |
| 8 | 21 | Change "main frame" to --mainframe--. |

UNITED STATES PATENT AND TRADEMARK OFFICE

CERTIFICATE OF CORRECTION

PATENT NO. : 5,548,375

DATED : 20 August 1996

INVENTOR(S) : Teruaki MITSUYA et al.

It is certified that error appears in the above-identified patent and that said Letters Patent is hereby corrected as shown below:

| Column | Line | |
|---|---|---|
| 8 | 32 | After "manner" insert --as to be--. |
| 8 | 54 | Change "those" to --that--. |
| 8 | 57 | Change "Those" to --That--. |
| 9 | 53 | After "device" insert --,--. |
| 9 | 54 | Change "having" to --have--. |
| 9 | 56 | After "14" insert --,--. |
| 10 | 6 | After "constantly" insert --,--. |
| 10 | 26 | Change "which" to --this--. |
| 10 | 29 | Change "of" to --to--. |
| 12 | 23 | Change "regard of" to --regard to--. |
| 12 | 39 | Change "of" to --to--; delete "which". |
| 12 | 56 | After "surface" insert --printing--; change "as well as" to --and--. |

UNITED STATES PATENT AND TRADEMARK OFFICE

CERTIFICATE OF CORRECTION

PATENT NO. : 5,548,375

DATED : 20 August 1996

INVENTOR(S) : Teruaki MITSUYA et al.

It is certified that error appears in the above-identified patent and that said Letters Patent is hereby corrected as shown below:

| Column | Line | |
|---|---|---|
| 13 | 6 | Delete "the". |
| 13 | 14 | Change "right hand" to --right-hand--. |
| 13 | 24 | Change "imagepattern" to --image pattern--. |
| 13 | 25 | After "112" insert --,--. |
| 13 | 26 | After "irradiation" insert --,--. |
| 13 | 28 | After "thereby" delete ",". |
| 13 | 29 | Change "to free" to --to be freed--. |
| 14 | 17 | After "fixed" change "," to --;--. |
| 14 | 42 | After "conjunction" change "of" to --with-- |
| 14 | 62 | Delete "because". |
| 14 | 66 | Change "thereby," to --whereby--. |

UNITED STATES PATENT AND TRADEMARK OFFICE

CERTIFICATE OF CORRECTION

PATENT NO. : 5,548,375

DATED : 20 August 1996

INVENTOR(S) : Teruaki MITSUYA et al.

It is certified that error appears in the above-identified patent and that said Letters Patent is hereby corrected as shown below:

| Column | Line | |
|---|---|---|
| 15 | 14 | Change "saving in" to --saving of--. |
| 15 | 37 | After "gear" insert --,--. |
| 16 | 5 | Change "exist" to --exists--. |
| 16 | 23 | After "printer" change "," to --;--. |
| 16 | 48 | After "temperature" change "," to --;--. |
| 16 | 55 | Change "devices" to --device--. |
| 17 | 1 | After "station 1" insert --,--. |
| 17 | 2 | After "fusing" insert --,--. |
| 17 | 9 | Change "devices" to --device--. |
| 17 | 46 | After "conjunction" change "of" to --with-- |
| 17 | 61 | Change "both surface side" to --both-surface-side--. |

UNITED STATES PATENT AND TRADEMARK OFFICE

CERTIFICATE OF CORRECTION

PATENT NO. : 5,548,375

DATED : 20 August 1996

INVENTOR(S) : Teruaki MITSUYA et al.

It is certified that error appears in the above-identified patent and that said Letters Patent is hereby corrected as shown below:

| Column | Line | |
|---|---|---|
| 18 | 19 | After "shown" change "," to --;--. |
| 18 | 66 | Change "operation" to --operations--. |
| 19 | 12 | After "thereby" delete ",". |
| 19 | 25 | Change "thereby, eliminate" to --thereby eliminating--. |
| 19 | 27 | Change "minimize" to --minimizing--. |
| 19 | 37 | After "thereby" delete ",". |
| 19 | 57 | Change "batches, thereby," to --batches; thereby--. |
| 19 | 66 | After "device" change "," to --;--. |
| 19 | 67 | After "thereby" delete ",". |

UNITED STATES PATENT AND TRADEMARK OFFICE

CERTIFICATE OF CORRECTION

PATENT NO. : 5,548,375

DATED : 20 August 1996

INVENTOR(S) : Teruaki MITSUYA et al.

It is certified that error appears in the above-identified patent and that said Letters Patent is hereby corrected as shown below:

| Column | Line | |
|---|---|---|
| 20 | 9 | Change "ucts, thereby," to --ucts; thereby--. |
| 22 | 42 | Before "images" delete "an". |
| 22 | 49 | After "device" insert --is--. |

Signed and Sealed this

Eleventh Day of March, 1997

*Attest:*

*Attesting Officer*

BRUCE LEHMAN

*Commissioner of Patents and Trademarks*